US005113892A

United States Patent [19]

Hull et al.

[11] Patent Number: 5,113,892

[45] Date of Patent: May 19, 1992

[54] FREEZE CONTROL AND DRAIN VALVE

[76] Inventors: Harold L. Hull, 401 Canyon Way #43, Sparks, Nev. 89434; Rudolph R. Romo, 833 O'neal; Donald J. Luschar, 923 Incline Way, both of Incline Village, Nev. 89450

[21] Appl. No.: 747,283

[22] Filed: Aug. 19, 1991

[51] Int. Cl.[5] ..... E03B 7/12; F16K 31/64

[52] U.S. Cl. ..... 137/62; 137/238; 137/312; 137/392; 137/549; 137/554; 137/558; 137/624.2; 137/487.5; 200/61.04; 210/223; 210/429; 210/456; 237/80; 307/118; 340/605; 340/620; 361/118

[58] Field of Search ..... 137/59, 61, 62, 79, 137/312, 386, 392, 486, 238, 489.5, 549, 558, 552.7, 554, 558, 624.18, 624.2, 624.21; 200/61.04; 340/604, 605, 618, 620, 581, 584, 825.06; 307/118; 361/178

[56] References Cited

U.S. PATENT DOCUMENTS

| | | | |
|---|---|---|---|
| 1,003,307 | 9/1911 | Walker | 137/61 |
| 1,137,405 | 9/1967 | Jennings . | |
| 1,875,513 | 9/1932 | Smith | 137/61 |
| 2,073,991 | 3/1937 | Koser | 210/456 |
| 2,074,640 | 4/1980 | Hibbert . | |
| 2,611,383 | 9/1952 | Tally | 137/61 |
| 2,636,506 | 4/1953 | St. Clair | 137/549 |
| 2,654,395 | 10/1953 | Kaye | 137/549 |
| 2,716,418 | 12/1950 | Borgerd | 137/61 |
| 2,922,616 | 1/1960 | Budde | 137/550 |
| 3,372,807 | 3/1968 | Barnard | 210/223 |
| 3,677,826 | 12/1970 | Pointout et al. | 251/30 |
| 3,834,539 | 9/1974 | Thompson | 210/223 |
| 3,856,260 | 12/1974 | Giordana | 251/129 |
| 3,967,808 | 7/1976 | Lieding | 251/46 |
| 4,081,171 | 3/1978 | Morgan et al. | 137/549 |
| 4,099,701 | 7/1978 | Berger | 251/30 |
| 4,108,419 | 8/1978 | Sturman et al. | 251/46 |
| 4,135,696 | 1/1979 | Saarem et al. | 251/30 |
| 4,180,088 | 12/1979 | Mallett | 137/87 |
| 4,206,901 | 6/1980 | Williams | 251/35 |
| 4,216,554 | 8/1980 | Gluecker et al. | 137/62 |
| 4,280,478 | 7/1981 | Duval et al. | 126/420 |
| 4,324,268 | 4/1982 | Jacobson | 340/620 |
| 4,360,037 | 11/1982 | Kendall | 137/242 |
| 4,502,958 | 3/1985 | Saski | 210/223 |
| 4,508,136 | 4/1985 | Kah, Jr. | 251/46 |
| 4,520,836 | 6/1985 | Hutter, III | 137/59 |
| 4,543,983 | 8/1985 | Pauliukonis | 137/356 |
| 4,635,668 | 1/1987 | Netter | 137/62 |
| 4,657,038 | 4/1987 | Lyons | 137/62 |
| 4,659,063 | 4/1987 | Veillette et al. | 251/68 |
| 4,730,637 | 3/1988 | White | 137/62 |
| 4,753,212 | 6/1988 | Miyaki et al. | 123/506 |
| 4,766,925 | 8/1988 | Frantz | 137/62 |
| 4,773,445 | 9/1988 | Visket | 137/595 |
| 4,783,266 | 11/1988 | Titch et al. | 210/223 |
| 4,817,666 | 4/1989 | Sanville | 137/596.17 |
| 4,835,426 | 5/1989 | Henville | 310/23 |
| 4,845,472 | 7/1989 | Gordon et al. | 340/605 |
| 4,865,076 | 9/1989 | Newcombe et al. | 137/602 |
| 4,944,253 | 7/1990 | Bellofatto | 137/312 |

*Primary Examiner*—George L. Walton

[57] ABSTRACT

A pressure-activated diaphragm valve which when installed in the main up-stream side of a pressurized line, responds to signals from a control unit to shut off the main supply line and at the same time, opens a drain port on the down-stream side of the valve. When used as a freeze protection system, the main water line is shut off and the drain port opened before the freeze point, thereby, eliminating water damage from frozen, broken pipes. The valve also is self-cleaning and has a magnetic plug to remove and keep metallic particles out of the control chamber and the control unit has automatic and manual modes.

16 Claims, 5 Drawing Sheets

FREEZE CONTROL AND DRAIN VALVE

FIELD OF THE INVENTION

This invention relates to hydraulic valves and more particularly to a self-contained valve that not only responds on demand to shut-off a main, up stream supply, but opens a port in the valve to drain the down stream supply out of the system thus, when used in a freeze protection system, prevents frozen, ruptured pipes and consequent water damage

BACKGROUND OF THE INVENTION

In the past a number of attempts have been made to address the multiple problems involved with freezing pipes and leaking water lines or appliances and fall into several well known, prior art fields namely;

1. Manual cut-off valves with some incorporating a waste or drain valve such as U.S. Pat. No. 1,003,307.

2. Dump valves which are sometimes manual while others are solenoid operated such as the dump valve for a cooling system as taught in U.S. Pat. No. 4,766,925 which is air activated. 3. Electrically controlled drip valves which open by an electrical solenoid to keep a small flow of water flowing through a given water circuit such as U.S. Pat. No. 4,635,688.

4. Solenoid operated shut-off valves which respond to a flood condition such as U.S. Pat. No. 4,324,268.

5. Flow control systems which measures the amount of water required in normal usage and when the usage exceeds the normal requirement shuts off the main upstream supply. One of these systems such as taught by White in U.S. Pat. No. 4,730,637 requires an extensive, complicated system which involves multiple shut-off and drain valves, flow sensors, etc.

6. Programmable systems such as proposed by Mallett in U.S. Pat. No. 4,180,088 which must be attended at least twice daily and incorporates a "flow sensor" which shuts off the water supply whenever flow occurs, no matter how minute, when the device is in the "automatic" position.

Each of the above approaches have inherent difficulties, which the present invention addresses while none of them, whether taken singly or in combination, disclose the specific details of the combination of the present invention in such a way as to bear upon the claims of the present invention.

SUMMARY OF THE INVENTION

It is a primary object of the present invention to provide a self-contained, multi-purpose flow control valve which on demand not only shuts off the upstream supply but drains the downstream supply, to outside atmosphere.

another object is to provide an internal filter in the control valve to keep foreign material out of the pilot valve control chamber of the control valve.

Still another object is to provide a self-cleaning internal filter that is kept clean of foreign material by the main flow of the supply and leads to the control chamber.

Yet another object is to provide a magnetic plug in the valve to capture and hold minute iron particles to keep them out of the control chamber and pilot valve.

Another important object to provide low voltage solenoids incorporated in the control valve unit to operate the internal main on/off valve and a second drain port valve to drain the system to outside atmosphere.

Yet another important object is to provide a control unit for the multi-purpose control valve which includes input from sensors and an off/on circuit which may be automatic or manual which operates the solenoids to fill or drain the system.

Still another object is to provide an auxiliary battery back-up.

Yet another important object is to incorporate in the valve a hydraulically closed drain valve which is a drain port which opens to drain the valve when no pressure exists on the downside.

A further object is to provide in the control unit a circuit which gives a pre-determined, timed pulse to the solenoids when in a drain position to affirm that the valves are indeed activated.

Yet another object is to provide a shipping package that is also used as insulation when installed around the valve.

A most important object is to provide all of the above functions in one valve unit instead of multiple valves.

It is to be recognized that the preferred embodiment, as shown and taught in the following drawings and specifications, teaches a freeze protection system to safeguard water lines of a water supply system for a building or the like before the pipes become frozen, but it will also be noted that the present invention may be used in other hydraulic applications not herein disclosed.

DETAILED DESCRIPTION OF THE DRAWINGS

Figure 1:
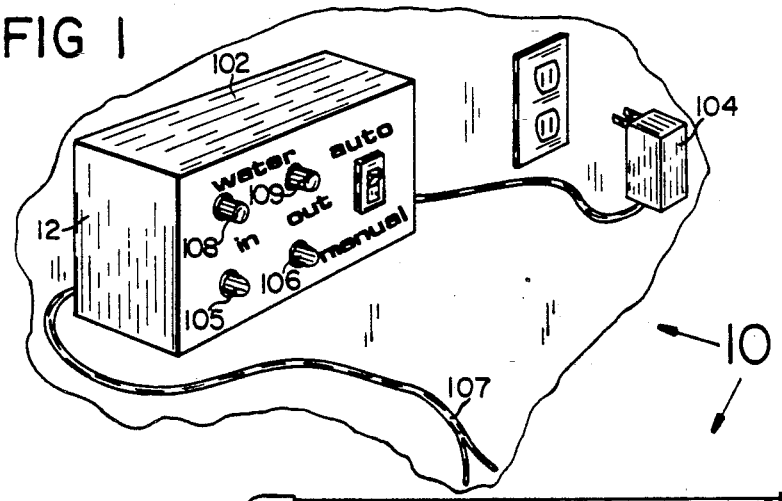
FIG. 1 is a perspective view of a control unit mounted on a wall and being ready to plug into an outlet.
Figure 2:
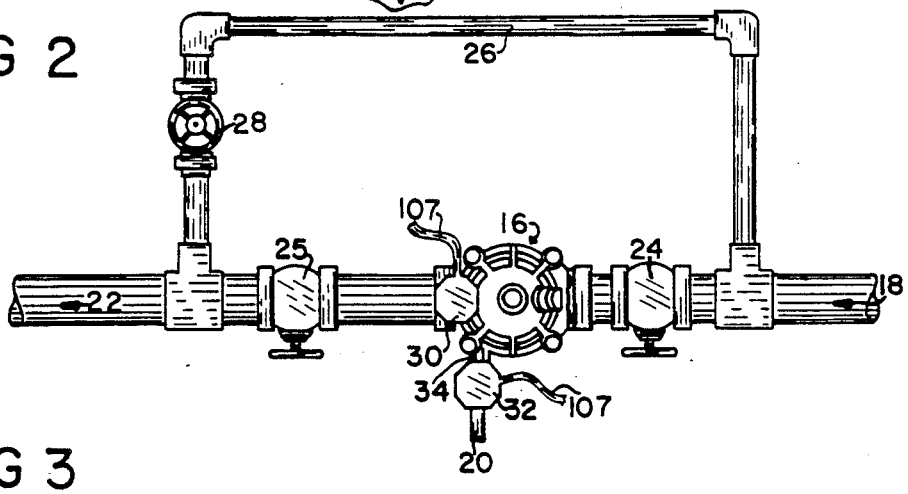
FIG. 2 is a plan view of the valve of the present invention installed in a typical water line.

Referring now to the drawings in detail wherein like characters refer to like elements throughout the various views, reference numeral 10 in FIGS. 1 and 2 depict a freeze protection and/or water damage system for safeguarding water supply lines of a building or the like against damage due to freezing or flooding during cold weather conditions.

The valve system 10 includes a control unit 12 having multiple temperature sensors 14 and 15 respectively for detecting the occurrence of a cold temperature condition approaching the freezing point of water or an excessive moisture condition. When such conditions are detected, the control unit 12 responds automatically, to close a shut-off valve 16 to disconnect the water lines from a water supply main 18 and to open a drain port 20 to drain residual water from the lines. With this arrangement, the valve system 10 protects the water lines as well as the associated building and its contents against freeze damage.

The freeze protection valve system 10 of the present invention provides a relatively simple yet, cost-efficient and reliable apparatus for automatic or manual disconnection and drainage of a water line network to a building or the like when a low temperature or moisture condition is detected. More specifically, with general reference to FIG. 1, water supply systems to residential and commercial buildings normally include a water line 22 coupled via a manual shut-off valve 24 to a water supply main 18. The water line 22 supplies water under pressure through a network of lines (not shown) for appropriate dispensing and use, for example, by operation of faucet valves, spigots, etc. As is well known, it is important to protect against freezing of water within the water lines to avoid pipe ruptures due to the expansive formation of ice and further to avoid water leakage which can cause major damage to a building and its contents. The present invention operates automatically or manually to safeguard against such freeze damage before the pipes become frozen.

As shown in FIGS. 1 and 2, the valve system 10 incorporates the shut-off valve 16 which is installed along the water supply main 18 at a convenient location normally protected against exposure to freezing temperatures. In a typical installation, the shut-off valve can be located at a relatively protected location within the crawl space beneath a building. Alternatively, in other cases, the shut-off valve can be disposed at a subterranean location beneath the normal soil frost line, such as within an underground vault. In either case, the shut-off valve 16 is normally installed adjacent to or in lieu of the standard manual shut-off valve 24. In a preferred arrangement as viewed in FIG. 1, the shut-off valve 16 is installed in-line between a pair of manual valves 24 and 25 in conjunction with a bypass conduit 26 having a manual valve 28 to permit removal of the automatic shut-off valve 16 for service or the like without interruption of normal water supply through the water line 22.

The automatic shut-off valve 16 comprises a solenoid operated valve assembly of the fluid pressure-responsive type. A primary solenoid unit 30 mounted on the valve 16 is operated by appropriate electrical signals to close or open the valve to water flow. A secondary solenoid unit 32 is mounted on a drain fixture 34 at one side of the valve 16 to open or close the drain port 20 in response to appropriate electrical signals. Such electrical signals are sent by the control unit 12 to operate the solenoid units 30 and 32 in coordination with each other to protect the water lines against freeze damage.

37 is an access plug containing permanent magnet 39 and made watertight by sealing ring 41 with 43 being an additional mechanical, pressure activated, drain valve containing plunger 45, spring 47, plunger head 51 (which is hexagonal in shape to allow water passage) and screens 53 and 55, respectively. valve 43 is a normally open, spring activated, mechanical valve which in absence of any pressure on the down stream side, opens to further drain the valve and acts as a back-up drain as well.

Figure 6:
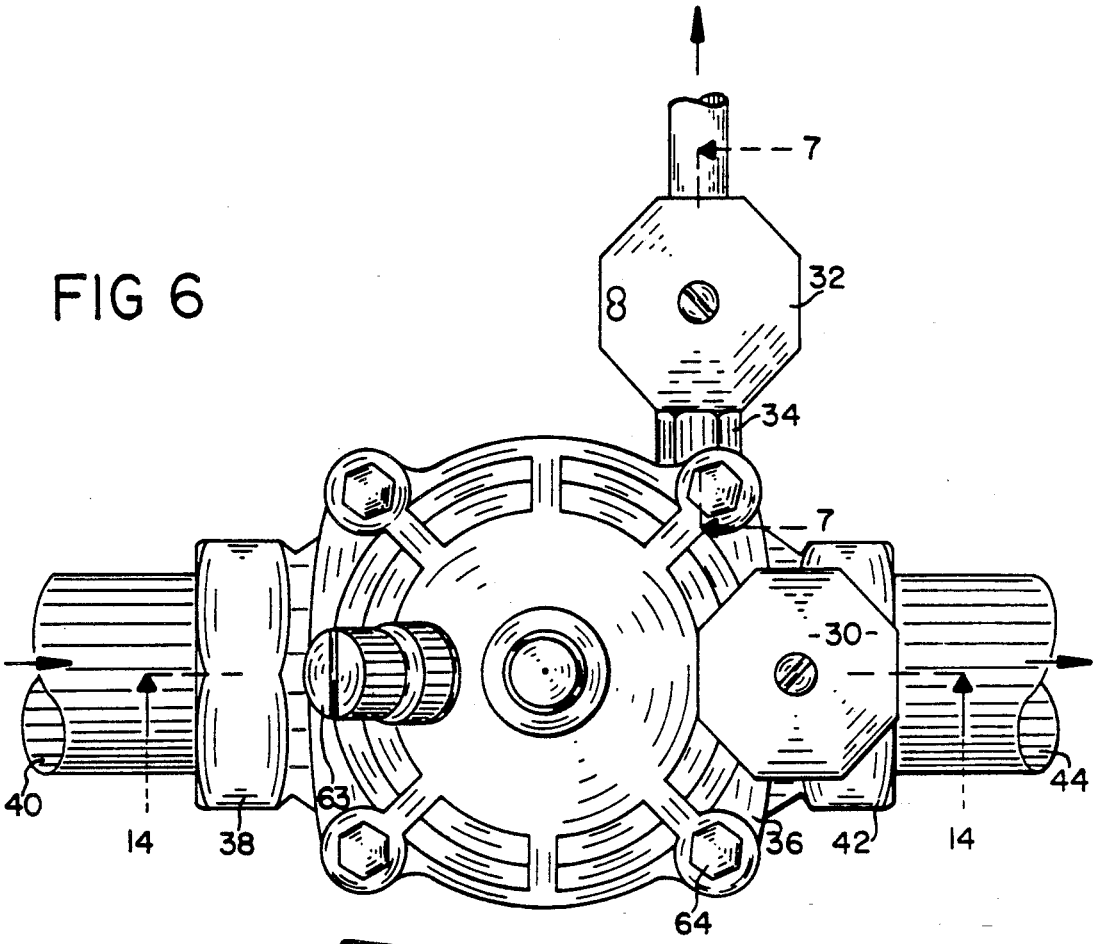
FIG. 6 is a top view of the valve installed in a system.
Figure 7:
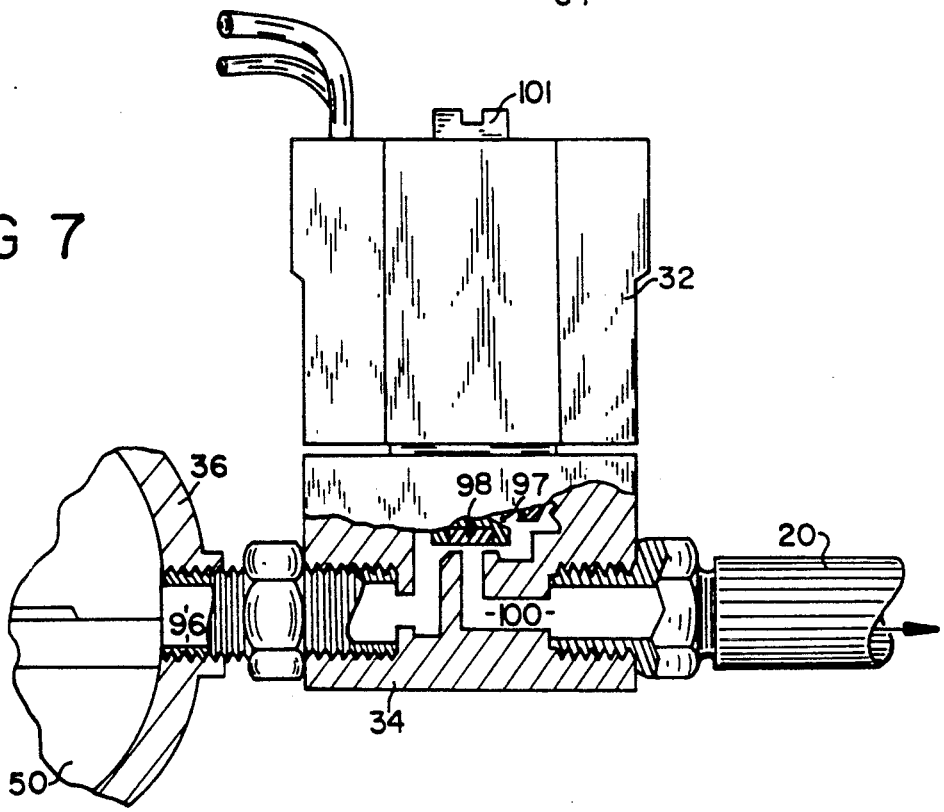
FIG. 7 is an enlarged partially fragmented view taken generally on the line 7—7 of FIG. 6.
Figure 8:
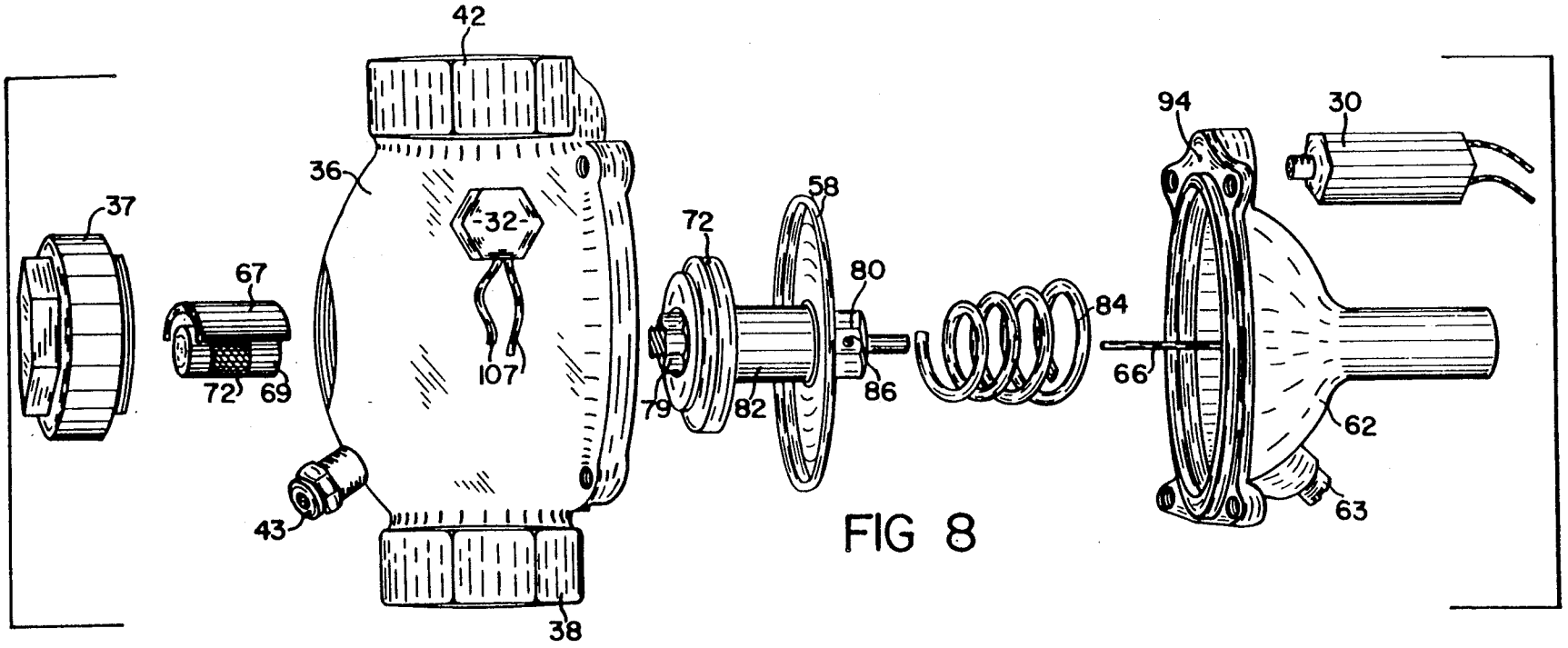
FIG. 8 is a perspective exploded view of the valve.
Figure 13:
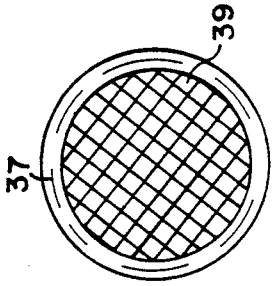
FIG. 13 is an inside view of the magnetic plug of FIG. 8 showing the magnetic section installed in the plug.
Figure 12:
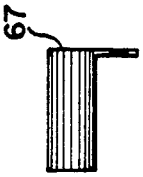
FIG. 12 is a side view of the dispersing device of FIG. 8.
Figure 11:
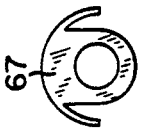
FIG. 11 is an end view of the dispersing device of FIG. 8.
Figure 10:
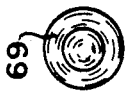
FIG. 10 is a end view of the filter in FIG. 8.
Figure 9:
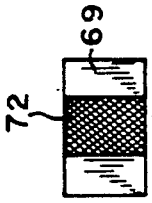
FIG. 9 is a side view of the filter in FIG. 8.
Figure 14:
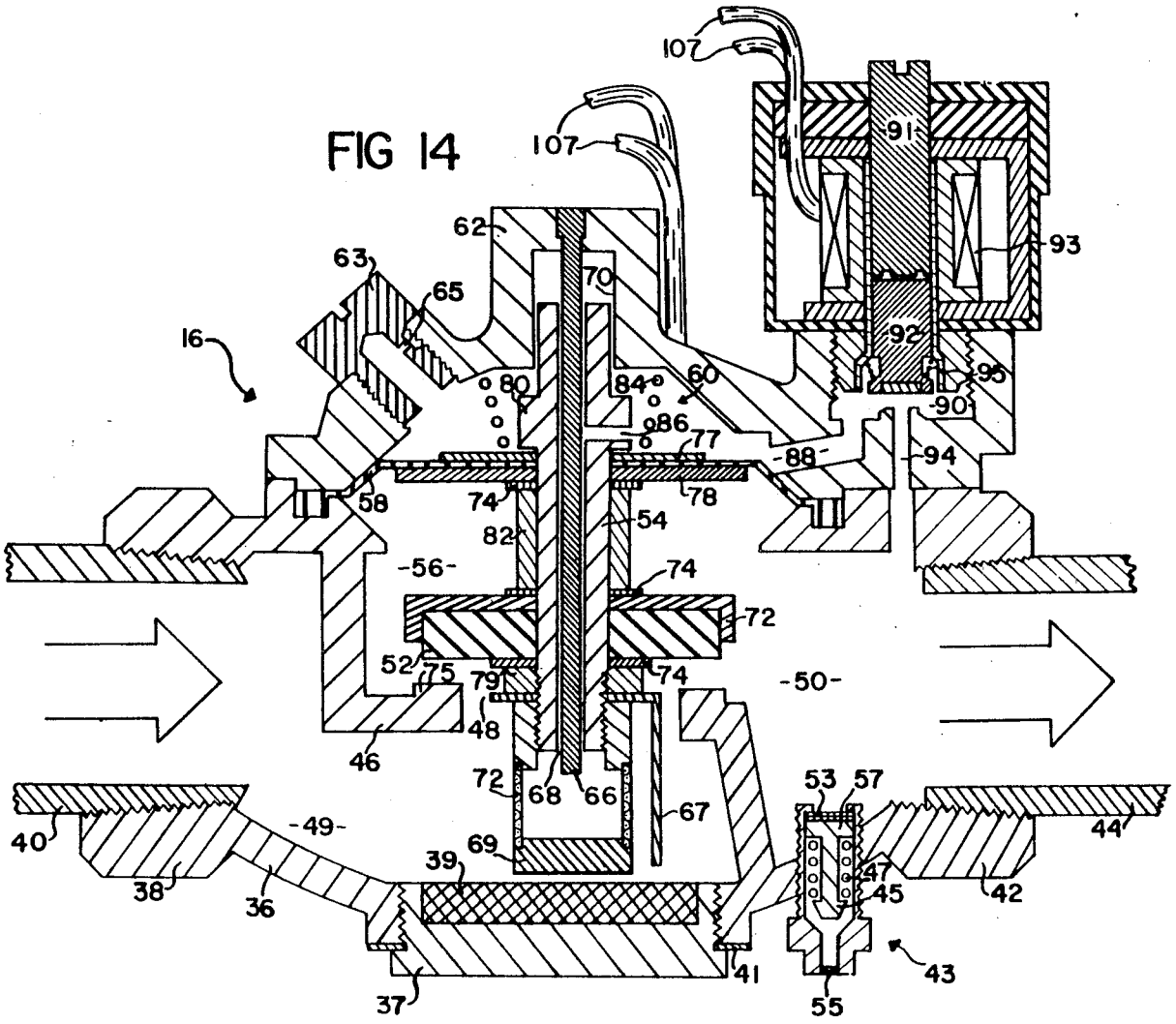
FIG. 14 is an enlarged fragmented, longitudinal, vertical, sectional view taken generally on the line 14—14.

A preferred geometry for the shut-off valve 16 is shown in FIGS. 6 and 7, and more particularly, as depicted in FIGS. 6 and 14, the shut-off valve 16 includes a valve housing 36 which normally has a cast construction of metal or plastic. The housing defines an inlet fitting 38 adapted for connection as by threading or the like to an inlet conduit 40 supplied with water from the main 18 and an outlet fitting 42 adapted for connection as by threading or the like to an outlet conduit 44 coupled to the water line 22. The interior of the valve housing 36 defines a flow path extending between the inlet and outlet fittings 38 and 42, wherein this flow path is interrupted by a central divider wall 46 shaped to provide an open valve port 48 for water flow therethrough. In particular, the divider wall 46 separates the housing interior into a lower upstream chamber 49 and an upper downstream chamber 50 which communicate with each other through the open valve port 48.

Figure 3:
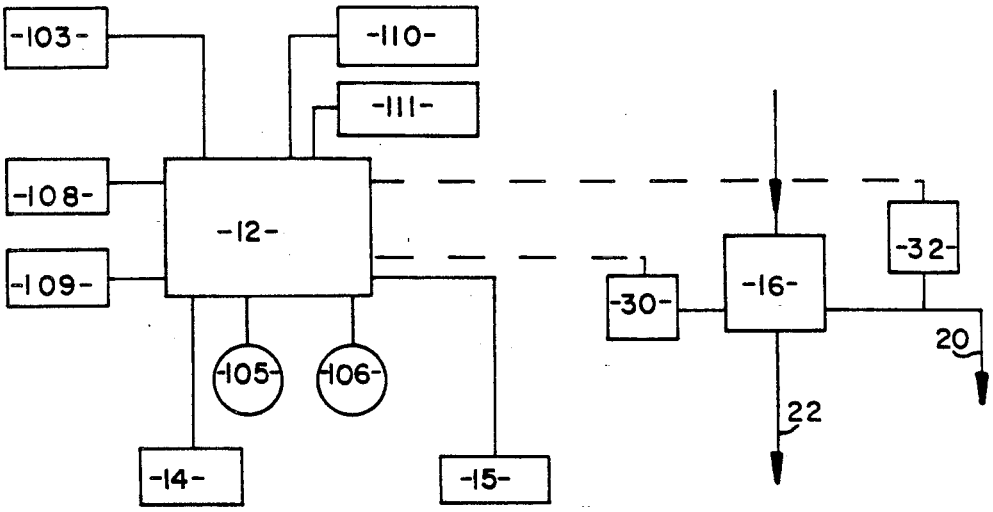
FIG. 3 is a schematic diagram of the system.

A valve head 52 is movably positioned in response to operation of the primary solenoid unit 30 to open or close the valve port 48. This valve head 52 is carried on a stem 54 which projects upwardly from the downstream chamber 50 through an enlarged opening 56 in the valve housing 36. The uppermost end of the stem 54 projects into operative association with a resilient diaphragm 58 and further into an upper control chamber 60 defined cooperatively by the diaphragm 58 and a bonnet 62 mounted onto the valve housing 36 over the opening 56 by means of mounting bolts 64 (FIG. 3) or the like.

63 is an external air bleed screw which opens port 65 to allow external evacuation of air trapped in chamber 60, while 67 is a water diffuser which directs a small portion of incoming water towards the back side of filter 69 which houses screen 72. Filter 69 is adapted for connection by threading or the like to stem 54 and filters the water going into chamber 60 and subsequently through valve ports 88, 90 and 94 respectively. The purpose of the filter 69 and permanent magnet 39 is to keep the contact valve surface 89 of plunger 92 and the valve seat 99 free of contaminants such as magnetic particles that may be attracted to the plunger 92 when the solenoid 30 is activated.

As shown best in FIG. 14, a stem guide pin 66 has an upper end anchored to the bonnet 62 and projects downwardly through the control chamber 60 and the underlying valve port 48. The valve stem 54 has a generally cylindrical geometry defining an integral longitudinal bore 68 to permit sliding stem mounting onto the guide pin 66. An upper end of the stem 54 is slidably restrained within a shallow counterbore 70 formed in the underside of the bonnet 62. A lower end of the stem 54 protrudes generally into the valve port 48. The valve head 52, formed preferably as a resilient annular disk member, is mounted about the stem within a downwardly open cup-like case 72, with the case 72 and valve head 52 being axially fixed onto the stem by retainer rings 74 and jam nut 79. The position of the valve head 52 on the stem 54 is chosen to permit valve head movement upon sliding translation of the stem between an open position retracted above an annular valve seat 75 bordering the port 48 (FIG. 4) and a closed position rested upon the valve seat 75.

The resilient diaphragm 58 has its peripheral edge sealingly trapped between the bonnet 62 and the valve housing 36. Stiffener plates 77 and 78, respectively, of annular shape are provided to reinforce a central region of the diaphragm while accommodating sealed passage of the valve stem 54 through the center of the diaphragm. Importantly, the central region of the diaphragm 58 is locked to the stem for displacement therewith, as by trapping the diaphragm between an upper shoulder 80 on the stem 54 and a lower bushing 82 carried about the stem. A compression spring 84 is mounted within the control chamber 60 and reacts between the bonnet 62 and the diaphragm 58 to urge the stem 54 in a direction seating the valve head 52 on the underlying valve seat 75.

In normal use and operation of the shut-off valve 16, water under pressure enters the upstream chamber 49 within the valve housing 36. The clearance tolerances between the guide pin 66 and the walls of the stem bore 68 permit water leakage through the stem bore 68 to a bleed port 86 formed in the stem above the diaphragm 58. The water under pressure thus fills the control chamber 60 and further passes through a discharge port 88 in the bonnet to a pressure chamber 90 associated with the primary solenoid unit 30. A solenoid plunger 92 within this pressure chamber 90 is normally retracted from an outlet port 94 leading to the downstream chamber 50. When the plunger 92 is in this retracted position, water bleeding into the control chamber 60 is drained via the solenoid unit 30 to the downstream side of the valve 16, thereby preventing the pressure in the control chamber 60 from rising to the pressure at the upstream chamber 49. In this configuration; the pressure at the upstream chamber 49 is sufficient to overcome closure forces attributable to the diaphragm spring 84, resulting in movement of the valve head 52 to the open position for normal water supply to the water line 22.

When the plunger 92 of the primary solenoid unit 30 closes the bleed port 86, the pressure level in the control chamber 60 rises to correspond with the pressure at the upstream chamber 49. When this occurs, a sufficient pressure differential acting across the diaphragm cooperates with the diaphragm spring 84 to close the valve head 52 on the valve seat 75. As a result, the water supply at the main 18 is disconnected from the water line 22. Such movement of the solenoid plunger 92, which preferably comprises part of a dual position latching solenoid assembly, occurs in response to detection of a low temperature condition or an excessive moisture condition by the sensors 14 and 15 respectively, (FIG. 3), as will be described. A permanent magnet 91 normally retains the solenoid plunger 92 in an open position retracted from the bleed port 86, until receipt of a signal pulse by a solenoid coil 93 to translate the plunger 92 toward a position closing the port 86. A compression spring 95 retains the plunger 92 in this closed position until a signal pulse of opposite polarity is received by the coil 93 to translate the plunger back to the open position.

The secondary solenoid unit 32 is carried by the drain fixture 34 mounted onto the valve housing 36 in flow alignment with a drain hole 96, (FIG. 7) adapted to open or close a fixture passage 100 leading to the drain 20. The secondary solenoid unit is also regulated by the sensors 14 and 15 respectively, (FIG. 3) and functions to close the drain when the shut-off valve is open for normal water supply. A compression spring 97 retains the plunger 98 in a position closing the drain port passage 100. However, when the shut-off valve is closed, a coil (not shown) of the solenoid unit 32 receives a pulse of appropriate polarity from the control unit 12 to retract the plunger 98 and open the drain to permit residual water in the line 22 and other system lines to drain out, thereby positively precluding freeze damage. A permanent magnet 101 retains the plunger in the retracted position until a subsequent pulse of opposite polarity is sent to the solenoid (not shown) of the solenoid unit 32 to return the plunger to the closed position.

The temperature sensor 14 comprises any convenient thermoelectric temperature responsive device such as a conventional bimetallic sensor or the like for detecting the occurrence of a selected low temperature condition approaching the freezing point of water, such as about 40 degrees F. In this regard, the sensor 14 is normally integrated into a compact control unit adapted for installation at a selected position whereat a low temperature condition is anticipated. For example, the sensor is desirably mounted remote from the shut-off valve 16 at a cold or drafty location within a building or the like. Alternatively, several temperature sensors can be mounted at different locations and adapted to signal the control unit 12 when the low temperature is detected at any one of the locations.

The moisture sensor 15 comprises any convenient responsive device for detecting the presence of moisture which, when moisture is present, allows current to flow (again, several sensors may be mounted at different locations) and is adapted to signal the control unit 12 when moisture is detected at anyone of the locations.

The control unit 12 includes appropriate programmed circuitry for operating the solenoid units 30 and 32 in response to the temperature and/or excessive moisture sensor input. More specifically, with reference to FIGS. 1 and 6, the control unit 12 is adapted for connection to a suitable electrical power supply 103 such as by connection of a conventional ac-dc transformer 104 to a standard household ac supply. When the temperature level at the sensor 14 is above the selected low temperature threshold, or the moisture sensor 15 is unactivated, indicator light 105 mounted on the control unit housing 102 is illuminated. However, when the selected low temperature threshold is reached, or the moisture sensor is activated, sensor 14 or 15 signals the control unit 12 which appropriately pulses the solenoid units 30 and 32 via sets of conductor wires 107 to close the shut-off valve 16 and open the drain port 20. This operation of the solenoid units 30 and 32 is accompanied by extinguishment of the green light 105 and illumination of a red light 106 to provide a visual indication that the water supply has been turned off.

Momentary switches 108 and 109 respectively are provided on the control unit housing 102 for manual system resetting when the two position switch 111 designated as auto or manual is in the manual position. Depression of the momentary switch 108 returns the system to the original state by pulsing the solenoid units to open the shutoff valve 16 and close the drain port 20. This allows use of the water system even when the temperature is below freezing and the system is used as usual by relying on heat tapes or allowing a faucet to drip.

The control unit 12 is also programmed for response to a power failure to prevent freeze damage in the event of cold temperature conditions during a power failure. In this regard, the control unit 12 is designed to detect interruption of the normal power supply and to switch automatically to a back-up battery 110 (FIG. 3) within the control unit housing 102. The system then automatically activates the solenoid units 30 and 32 to close the shut-off valve 16 and open the drain port 20. The status lights 105 and 106 are turned off when a power failure occurs to conserve battery reserves. Subsequent depression of the reset button 108 will activate the solenoid units 30 and 32 for a system reset to normal operation, provided that the temperature sensor does not detect a low temperature condition. If the low temperature condition is sensed, reset will not occur.

Figure 4:
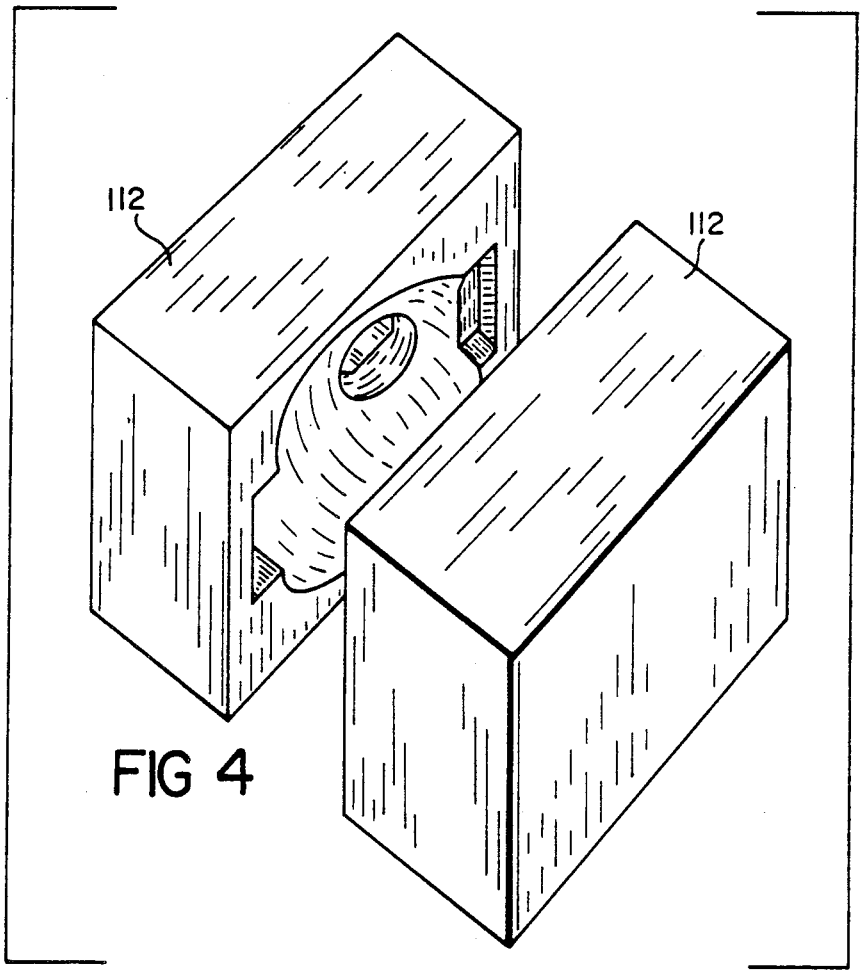
FIG. 4 is a perspective view of a combination shipping carton and insulation means.
Figure 5:
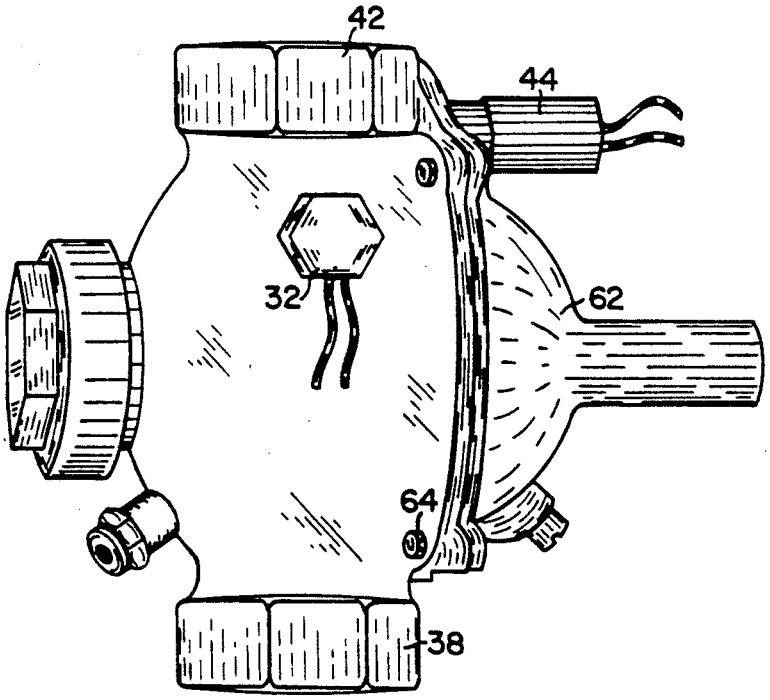
FIG. 5 is a perspective side view of the valve fully assembled.

A combination shipping and insulation container 112 is shown in FIG. 4 which allows the installer to insulate the valve after it is installed.

One preferred control circuit geometry for control of the system is by the use of control circuit modular #594-B as manufactured by TRIPLE SEVEN INDUSTRY of Sparks, Nev., which includes circuitry to not only reverse polarity on demand but includes a timer designed to supply confirmation pulses at intervals for repeated triggering of the solenoid units in the event the plungers therein hang up for any reason. In this regard, the timer may be programmed to supply confirmation pulses indefinitely, or a limited number of pulses before cessation of operation.

The control unit 12 also includes the battery reserve power supply 110 for automatically energizing the circuit in the event of main power interruption.

The freeze protection valve system 10 thus provides an automatic apparatus responsive to temperature conditions to disconnect a building water supply and to drain residual water from the water lines. Freeze damage to the water lines and/or to the building and its contents is thus avoided.

It will now be seen that we have provided a self-contained, multi-purpose flow control valve which, in the preferred embodiment, is adapted to be used in a versatile and/or moisture control system, which requires only one installation break-in point in a water system, with no other valves being required.

We have also provided a unique and novel filter and magnetic plug arrangement to keep the control chamber and pilot valve free of contaminants such as magnetic particles, etc.

Also, we have provided a system that only requires low voltages to operate and has a back-up battery system in case of power failure.

It will be noted that we have also provided in the control unit, a circuit which pulses the solenoids at timed intervals to re-affirm that the solenoids are activated.

Also, a back-up mechanical drain valve to further drain the system and more particularly the valve itself, is provided.

It will be further noted that we have provided a combination shipping carton and insulation package which may be installed around the valve to further protect it from freezing.

It will be further noted that we have provided at the control unit, a simple manual or automatic mode switch which allows the unit to operate on demand in below freezing temperatures or upon leaving the premises for a length of time, either to drain the system or put it on automatic.

A variety of modifications and improvements to the valve system 10 are believed to be apparent to those skilled in the art. For example, the sensors 14 and 15 can be modified for sensing other types of parameters or used in combination with other sensors designed to sense other parameters. For example, motion sensors can be used to detect an earthquake event or excessive vibration. Accordingly, no limitation on the invention is intended by way of the foregoing description and the accompanying drawings, except as set forth in the appended claims.

What we claim and wish to protect by letters patent is:

1. A pressure, activated diaphragm valve adapted to be installed in a liquid supply line comprising a body member, said body member having means to attach to an up-stream supply line and a down-stream discharge line, a seat mounted within said body member, a plug member co-operable with said seat to form a diaphragm valve control chamber, inlet and outlet passageways connecting said chamber with said liquid supply line, a solenoid valve means to control the amount of said liquid in said control chamber to control the relationship between said plug member and said seat, said plug member having a first and second position, said first position allowing said liquid to flow from said up-stream supply line to said down-stream discharge line, said second position of said plug member not allowing said liquid to flow from said up-stream supply line to said down-stream discharge line, a solenoid valve drain means for draining said liquid from said down-stream discharge side of said body member, said drain means having a first and second position, said last named first position not allowing said liquid to drain from said body member, said ast named second position allowing said liquid to drain from said body member, actuator means for actuating said means to control the electrical amount of said liquid in said control chamber and said drain means, control means for said actuator means, said control means responding lest one sensor, whereby, when said sensor responds automatically to a first predetermined condition, said control means actuates said actuator means to cause said plug member to assume it's said second position and at the same time causes said drain means to assume it's said second position, thereby shutting off said up-stream supply line when said plug member is seated on said valve seat and draining said liquid in said down-stream discharge line of said body member when said drain means is in its draining position and, when said sensor responds automatically to a second predetermined condition, said control means actuates said actuator means to cause said plug member to assume its said first position and at the same time causes said drain means to assume its said first position, thereby allowing said liquid to flow between said up-stream supply line and said down-stream discharge line when said plug member is unseated from said valve seat and closing said solenoid valve drain means to prevent draining of said liquid flow in said down-stream discharge line.

2. The valve of claim 1 in which said means to control the amount of said liquid in said control chamber is a supply port operable by said solenoid valve means.

3. The valve of claim 1 in which said drain is a drain port, said port being operable by said solenoid valve drain means.

4. The valve of claim 1 in which said means to control the amount of said liquid in said control chamber and said drain means are operable by two position, latching solenoids.

5. The valve of claim 4 in which said control means is remote from said valve and includes means for supplying signal pulses of opposite polarity to said latching solenoid units.

6. The valve of claim 1 in which said control means include a circuit which gives a pre-determined, timed pulse to said solenoids when said solenoids are in a shut-off and drain position.

7. The valve of claim in which said sensor is a temperature sensor.

8. The valve of claim 1 in which said sensor is a moisture sensor.

9. The valve of claim 1 in which said control unit means include a two-position switch, said switch activating circuits to determine an automatic or manual mode.

10. The valve of claim 1 including means to filter said liquid in said control chamber.

11. The valve of claim 10 in which said filter has self-cleaning means.

12. The valve of claim 11 in which said self-cleaning means is by directing the force of the supply liquid to engage all sides of said filter.

13. The valve of claim 1 including a magnetic plug in said body member.

14. The valve of claim 1 including a normally open, hydraulically closed, auxiliary drain valve on said down-stream side of said body member.

15. The valve of claim 1 including a shipping package suitable for use as insulation after installation.

16. The valve of claim 1 in which said control means include an auxiliary battery and a circuit to switch to said battery in event of power failure.

* * * * *